US006936956B2

(12) United States Patent
Ikeuchi et al.

(10) Patent No.: US 6,936,956 B2
(45) Date of Patent: Aug. 30, 2005

(54) DISCHARGE LAMP HAVING AN ELECTRODE BODY WITH A HERMETICALLY SEALED SPACE THAT IS PARTIALLY FILLED WITH A HEAT CONDUCTOR

(75) Inventors: Mitsuru Ikeuchi, Himeji (JP); Katsumi Shojo, Takasago (JP); Yoichi Kono, Kakogawa (JP)

(73) Assignee: Ushiodenki Kabushiki Kaisha, Tokyo (JP)

( * ) Notice: Subject to any disclaimer, the term of this patent is extended or adjusted under 35 U.S.C. 154(b) by 146 days.

(21) Appl. No.: 10/420,747

(22) Filed: Apr. 23, 2003

(65) Prior Publication Data

US 2003/0201719 A1 Oct. 30, 2003

(30) Foreign Application Priority Data

Apr. 26, 2002 (JP) ..... 2002-125682
Jan. 24, 2003 (JP) ..... 2003-015711

(51) Int. Cl.[7] ..... H01J 1/14; H01J 19/06

(52) U.S. Cl. ..... 313/346 R; 313/356; 313/618; 313/631

(58) Field of Search ..... 313/618, 356, 313/346 R, 631, 632, 633, 634, 635, 332, 340

(56) References Cited

U.S. PATENT DOCUMENTS 3,014,156 A * 12/1961 Osterhammel et al. ..... 315/224
3,636,401 A * 1/1972 Cortorillo et al. ..... 313/352
3,675,068 A * 7/1972 Strauss ..... 313/623
4,190,786 A * 2/1980 Kira ..... 315/358
5,633,556 A * 5/1997 Fujina et al. ..... 313/32
2002/0017860 A1 * 2/2002 Nishida et al. ..... 313/568

* cited by examiner

*Primary Examiner*—Mariceli Santiago
*Assistant Examiner*—Elizabeth Rielley
(74) *Attorney, Agent, or Firm*—Nixon Peabody LLP; David S. Safran

(57) ABSTRACT

A discharge lamp with a high output power in which an increase of the current to be supplied to the discharge lamp can be enabled without the need to enlarge the discharge lamp and the surrounding system. The discharge lamp includes an arc tube having a pair of opposed electrodes, at least one of the electrodes having an electrode body in which a hermetically sealed interior space is formed, and a heat conductor partially filling the hermetically sealed interior space. This heat conductor consists of metal that has a higher thermal conductivity or a lower melting point than the metal comprising the electrode body.

17 Claims, 4 Drawing Sheets

DISCHARGE LAMP HAVING AN ELECTRODE BODY WITH A HERMETICALLY SEALED SPACE THAT IS PARTIALLY FILLED WITH A HEAT CONDUCTOR

BACKGROUND OF THE INVENTION

1. Field of the Invention

The invention relates to a discharge lamp. The invention relates especially to a discharge lamp of the short arc type that is used as a light source for a projection device, a photochemical reaction device, and an inspection device.

2. Description of Related Art

Discharge lamps can be classified into different lamp types with respect to the emission substance, the distance between the electrodes, and the internal pressure of the arc tube. With respect to the type of lamp classified by its emission substance, there are xenon lamps, with xenon gas as the emission substance, mercury lamps with mercury as the emission substance, metal halide lamps with rare earth metals besides mercury as the emission substance, and the like. With regard to the type of lamp classified by the distance between the electrodes, there are discharge lamps of the short arc type, and discharge lamps of the long arc type. With respect to the type of lamp classified by the vapor pressure within the arc tube, there are low pressure discharge lamps, high pressure discharge lamps, ultra high pressure discharge lamps, and the like.

In a high pressure mercury lamp of the short arc type, there are tungsten electrodes with a distance from roughly 2 mm to 12 mm in an arc tube made of silica glass with a high thermal stability temperature, and the arc tube is filled with a gas, such as mercury, argon, or the like, as the emission substance with a vapor pressure during operation of $10^5$ Pa to $10^7$ Pa. Since it is advantageous in that the distance between the electrodes is short and high radiance can be obtained in this high pressure mercury discharge lamp of the short arc type, it is conventionally often used as a light source for exposure in lithography.

On the other hand, recently it has been considered not only as the light source for exposing a semiconductor wafer, but also as the light source for exposure of a liquid crystal substrate, especially a liquid crystal substrate used for a liquid crystal display with a large area. Also, with respect to an increase of throughput in the production process, there is a high demand for increasing the output power of a lamp used as a light source.

When the output power of the discharge lamp is increased, the nominal power consumption is also increased. The value of the current flowing into the discharge lamp generally increases even if it depends on the computed data of the current and the voltage.

With respect to the electrodes, especially the anode, during operation using a direct current the amount of electron bombardment increases. This leads to the disadvantage in which the electrodes' temperature increases slightly causing melting. In a discharge lamp which is positioned in the vertical direction, the electrode, not limited to an anode, is located at the top and is influenced by the heat convection in the arc tube or the like. The electrode receives heat from the arc more intensely, and is, thus, subjected to a temperature increase causing it to melt.

If the electrode, especially its tip area, melts, the arc becomes disadvantageously unstable, and, moreover, the material comprising the electrode vaporizes and adheres to the inside surface of the arc tube causing radiation output to decrease.

Such phenomenon is not limited to a high pressure mercury discharge lamp of the short arc type, but is disadvantageously and generally occurred in the case of an increase of the output power of a discharge lamp. Hence, conventionally, there are an arrangement and a process in which an air cooling device and compressed air cooling is carried out outside the discharge lamp. In a discharge lamp with a greater output power, a so-called discharge lamp of the water cooling type has been proposed, for example, by Japanese Patent No. 3075094, or U.S. Pat. No. 5,633,556, in which within the electrode there is a cooling water passage allowing cooling water to flow.

In the process where increasing the output power of the discharge lamp is possible by using an air cooling device located outside the discharge lamp to provide forced air cooling, the current that can be introduced into the discharge lamp however still has a boundary value or upper limit. Therefore, it is difficult to increase the output power even with external air cooling. This boundary value differs slightly depending on the type of discharge lamp and environment in which the discharge lamp is located. The value of the current supplied to the discharge lamp is roughly 200 A. An increase in the current exceeding this value was not possible in practice.

In the case of a discharge lamp of the water cooling type, water is fed into the electrode and is allowed to flow out. In the vicinity of the discharge lamp there must be a circulation pump, a system for feeding cooling water, and a drain device. As a result of having the cooling system, the discharge lamp is increased in size. A cooling device, which is many times larger than the discharge lamp, is required. The water cooling process may, therefore, indeed be useful for special applications, but has only little general utility for a discharge lamp. Particularly, it cannot not be maintained especially and suitably for a light source of an exposure device for lithography used in a clean room.

Moreover, in a process depending only on a forced cooling device, there is an area within the arc tube with an especially low temperature where a filler, such as mercury or the like, collects in the unvaporized state. In such a case, the given operating pressure of the discharge lamp is not obtained, and neither the desired amount of radiant light nor the desired radiance is obtained. In the case where the temperature within the arc tube has dropped unduly, the arc formed between the electrodes becomes unstable, thereby causing vaporization and flickering of the discharge lamp.

SUMMARY OF THE INVENTION

Therefore, a primary object of the present invention is to eliminate the above described disadvantages in the prior art. Specifically, it is an object of the invention to devise a discharge lamp with a high output power in which an increase of the current to the discharge lamp is possible without the need to increase the size of the discharge lamp and its surrounding system.

According to a first aspect of the invention, in a discharge lamp there is a pair of opposite electrodes within an arc tube, and at least one of the electrodes has an electrode body wherein a hermetically sealed space is formed. Further, there is a heat conductor located in this hermetically sealed space. This heat conductor consists of metal which has a higher thermal conductivity than the metal comprising the electrode body. In the present invention, the term "metal which has a higher thermal conductivity" is defined as a single metal, a mixture of two or more different metals, or an alloy of two or more metals, where the alloy has a higher thermal conductivity than the metal comprising the electrode.

Further, the electrode body consists of a metal with tungsten as a main component. In this case, the wall thickness of the electrode body on the side of the opposite electrode is preferably greater than or equal to 2 mm and less than or equal to 10 mm. Furthermore, the wall on this electrode is preferably doped with greater than or equal to 1 wt. ppm and less than or equal to 50 wt. ppm potassium. Furthermore, the heat conductor preferably contains one of the metals gold, silver and copper.

According to a second aspect of the invention, there is a pair of opposite electrodes within a arc tube in a discharge lamp, and in which at least one of the electrodes has an electrode body wherein a hermetically sealed space is formed. The heat conductor is located in this hermetically sealed space, and the heat conductor consists of a metal which has a lower melting point than the melting point of the metal comprising the electrode body. Again, the term "metal which has a lower melting point" is directed to a single metal, a mixture of metals, or an alloy.

The heat conductor contains one of the metals gold, silver, copper, indium, tin, zinc and lead.

The discharge lamp of the present invention is operated such that its tube axis is located in the vertical direction, and the electrode having the electrode body and the heat conductor is located at the top.

In a discharge lamp according to the above-described first aspect of the invention, the electrode comprises the electrode body wherein the hermetically sealed space is formed for holding the heat conductor which consists of a metal with a higher thermal conductivity than the metal comprising this electrode body. Due to the high heat transport effect of this heat conductor in the axial direction of the lamp, heat can be effectively transported when the tip area of the electrode reaches a high temperature. Therefore, it is possible to advantageously eliminate the defect of melting electrode when the current is increased to increase the output power of the discharge lamp.

In a discharge lamp according to the second aspect of the invention, by the arrangement in which the heat conductor is a metal with a lower melting point than the melting point of the metal comprising the electrode body, the convection effect and the boiling transfer action of the heat conductor which is in the liquid state during operation of the discharge lamp can be used. By the second aspect of the invention, heat can be transported from the tip area of the electrode with high efficiency. Therefore, as in the first aspect of the invention, it is possible to advantageously eliminate the defect of melting electrode in the prior art when the current to be supplied is increased to increase the output power of the discharge lamp.

The invention is described in further detail with reference to the accompanying drawings.

DETAILED DESCRIPTION OF THE INVENTION

Figure 1:
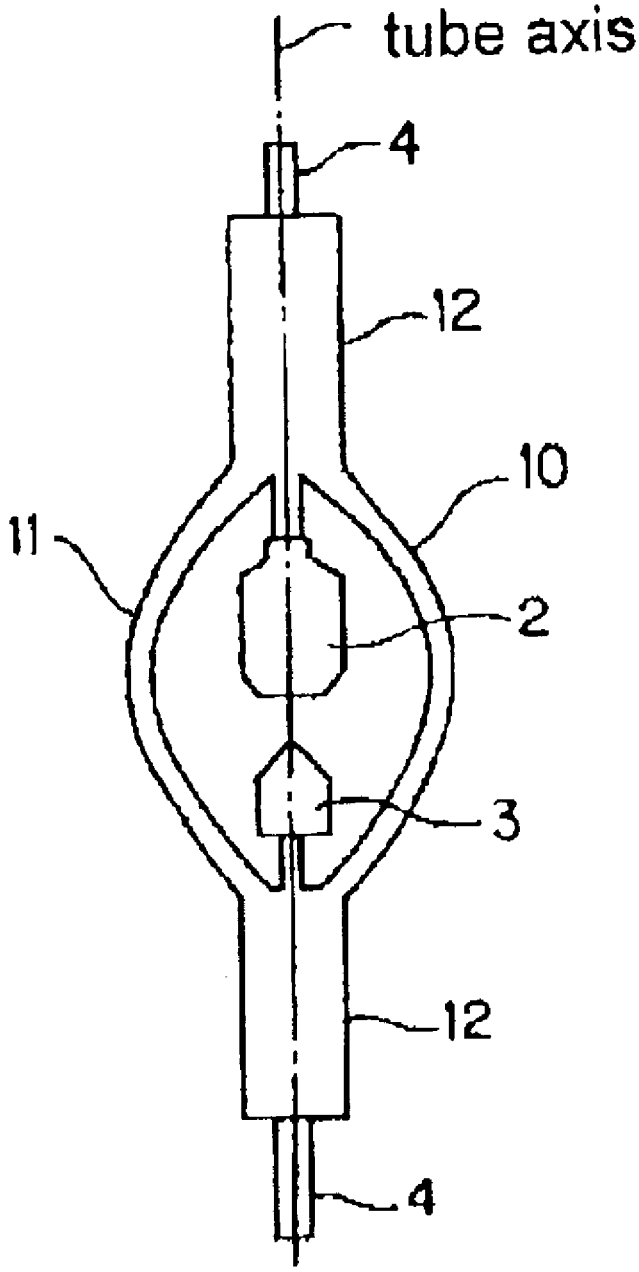
FIG. 1 shows an overall view of a discharge lamp of the present invention.

FIG. 1 shows a schematic of the overall arrangement of a discharge lamp of the present invention. It applies both to the first and also to the second aspect of the invention. A silica glass arc tube 10 has a spherical light emitting part 11 at opposite ends of which there are hermetically sealed portions 12. In this light emitting part 11, there are two opposed electrodes, specifically an anode 2 and a cathode 3. Each of the electrodes 2, 3 is held by the hermetically sealed portion 12 and is connected via a metal foil (not shown), to an outer lead pin 4, to which an outside current source (not shown) is connected. The light emitting part 11 is filled with an emission substance, such as mercury, xenon, argon and the like, and a starting gas in predetermined amounts. When power is supplied to the discharge lamp from the outside current source, emission takes place by an arc discharge at the anode 2 and the cathode 3. This discharge lamp is a so-called discharge lamp of the vertical-operating type, which is operated such that the anode 2 is located at the top and the cathode 3 is located at the bottom, and the tube axis of the light emitting part 11 runs in a vertical direction with respect to the ground.

Figure 2:
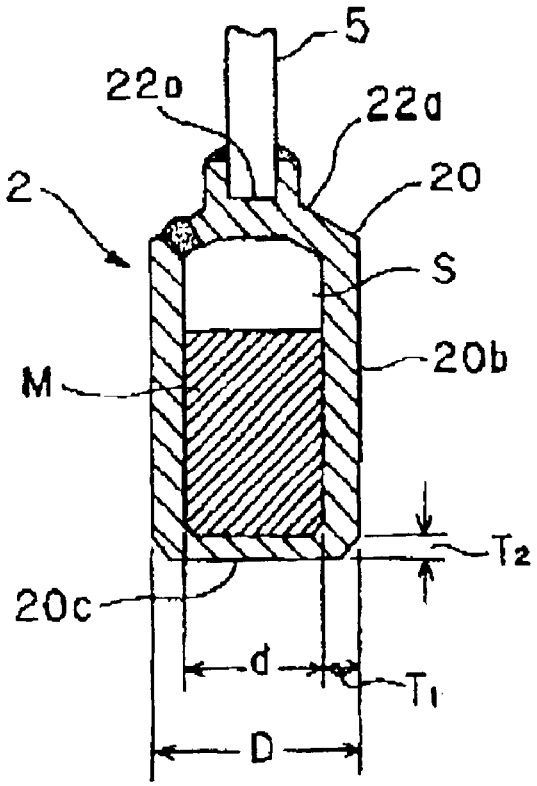
FIG. 2 shows a schematic of the anode of the present invention.

FIG. 2 shows a cross section of the anode 2 according to the first aspect of the invention. The anode 2 has an electrode body 20 in which there is a heat conductor M. The electrode body 20 includes a metal with a high melting point, or an alloy with a metal with a high melting point as the main component. The electrode body 20 is made in the form of a vessel in which a hermetically sealed space S, or interior space, is formed. The heat conductor M is a metal that is added and is hermetically enclosed in electrode body 20, and the heat conductor M has a higher thermal conductivity than the metal comprising the electrode body 20. The electrode body 20 has a back end 22*a* connected to an axial part 5, a body 20*b* and a tip area 20*c*. The back end 22*a* is provided with an opening 22*o* into which the axial part 5 is inserted. According to another embodiment of the present invention, the electrode also includes the axial part 5.

The metal comprising the electrode body 20 is a metal with a high melting point of at least 3000 K, such as tungsten, rhenium, tantalum or the like. In particular, tungsten is advantageous because it rarely reacts with the heat conductor M within the electrode body 20. So-called pure tungsten with a purity of at least 99.9% is even more advantageous.

Furthermore, the electrode body may be an alloy which has a metal with a high melting point employed as the main component. For example, a tungsten-rhenium alloy, with tungsten may be used as the main component. In the case where a high melting-point metal is used, the service life of the electrode can be prolonged due to the resistance to dynamic stress of a high temperature.

The heat conductor M is made of a metal with higher thermal conductivity than the metal comprising the electrode body 20. Specifically, in the case of using tungsten as the material comprising the electrode body 20, gold, silver, copper or an alloy can be used for the heat conductor M with the-above listed metals as the main component. Of these metals, silver and copper are preferred materials, silver being an especially preferred metal. The reason for this is that, at roughly 2000 K, the thermal conductivity of silver is roughly 200 W/mK, and the thermal conductivity of copper is roughly 180 W/mK, which is high in both cases, while the thermal conductivity of tungsten is roughly 100 W/mK. Furthermore, since silver and copper do not form an alloy with tungsten, they are also preferred metals as they are stable as a heat transport body.

Of course, the thermal conductivity of the metal comprising the electrode body 20 should be compared to the thermal conductivity of the metal comprising the heat conductor M at the same temperature. Therefore, the thermal conductivities of the two metals can be compared to one another at 2000 K as the general temperature level of the anode during operation of the discharge lamp or at room temperature.

Furthermore, as another specific example, in the case of using rhenium as the metal comprising the electrode body 20, tungsten can be used as the heat conductor M. This is because the thermal conductivity of rhenium is roughly 52 W/mk at 2000 K, while at 2000 K the thermal conductivity of tungsten is roughly 100 W/mK, as was described above.

The advantage in using rhenium as the metal comprising the electrode body 20 is that, in the case of a mercury lamp or a metal halide lamp filled with halogen, corrosion of the electrode can be prevented. Hence, the service life of the discharge lamp can be prolonged.

The electrode body 20 is formed essentially in the shape of a vessel with its interior formed as a hermetically sealed space. Even if the heat conductor M reaches a high temperature and partially vaporizes, no material passes into the emission space of the light emitting part 11. According to the present invention, the electrode body is an inherent cooling device.

In the discharge lamp of the invention, a device for supplying or draining coolant from the outside, as in a discharge lamp of the water-cooling type, is not necessary, and the cooling effect of the present invention can be obtained by an extremely simple arrangement. In addition, after the one-time production of the discharge lamp, until the end of the service life of the discharge lamp, the cooling effect of the electrode body can be operational without interruption and without the heat conductor M inside the electrode body 20 having to be replenished.

The discharge lamp of the present invention of the type with high output power has a major difference compared to the conventional discharge lamp having a cooling device located outside of the discharge lamp. As previously mentioned, in the discharge lamp of the present invention, the lamp inherently has a cooling function with an extremely simple arrangement of the heat conductor M having the above-discussed characteristics housed inside the electrode body 20.

In the case where the metal comprising the electrode body 20 is a multicrystal body, such as tungsten, by fixing the shape and the size of the crystal grains, a more effective electrode can be formed. Specifically, a relation essentially of L<W is advantageous when the length of the crystal grains in the same direction as the tube axis of the discharge lamp is designated L and the length in the direction perpendicular thereto, as in FIG. 2, based on the direction shown by D, is labeled as W. The reason for this is that the thermal resistance characteristic increases because the length W in the direction perpendicular to the length L is greater than the length L in the direction of the tube axis of the crystal grain. Furthermore, it is more advantageous for the grain size of the crystal grains comprising the tip area 20*c* of the electrode body to be smaller than that of the crystal grains comprising the body 20 and the back end 22*a*. This is because a fracture due to thermal stress can be prevented even more with the smaller the grain size.

Below are exemplary numerical values of L and W.

The length L is in the range from 40 microns to 80 microns, preferably 60 microns;

The width W is in the range from 50 microns to 90 microns, preferably 70 microns;

The grain size of the tip area 20*c* is in the range from 40 microns to 80 microns, preferably 60 microns; and The grain size of the back end 22*a* is in the range from 40 microns to 160 microns, preferably 100 microns.

In the case where the electrode body 20 is made of tungsten or of an alloy with tungsten as the main component, it is advantageous to dope the electrode body 20 with roughly 1 wt. ppm to 50 wt. ppm potassium. The reason for doping is to suppress the crystal growth of the tungsten and to keep the mechanical strength high in the case of high temperature.

Furthermore, it is advantageous to dope especially the tip area 20*c* of the electrode body 20 with potassium. This is because the tip area of the electrode easily reaches a high temperature, and as the tungsten crystals grow in the above described manner, the tip area of the electrode often becomes brittle. By doping the electrode body 20 with potassium, the thickness T2 of the wall of the tip area 20*c* and the thickness T1 of the wall of the body 20*b* can be reduced. In this way, the heat transport effect can be increased even more than in an electrode body of tungsten without doping with potassium. As a result, it becomes possible to have a greater current to flow in the electrode body.

Furthermore, it is advantageous to fill the interior S of the electrode body 20 with a suitable oxygen getter together with the heat conductor M. The concentration of dissolved oxygen in the electrode body 20 can be reduced, and oxidation of the material comprising the electrode body 20 can be prevented.

It is advantageous for the concentration of the dissolved oxygen to be at most 10 wt. ppm. The oxygen getter can be, for example, a lower oxide of barium, calcium or magnesium or a metal like titanium, zirconium, tantalum, niobium, or the like.

Figure 3:
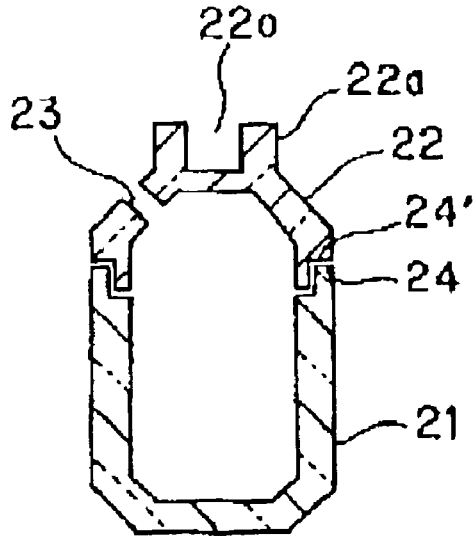
FIG. 3 shows a schematic of the electrode body of the present invention.

FIG. 3 shows an exploded cross-section of the electrode 2 in conjunction with the production process. The main component 21, the cover component 22, and the like are shown herein. The process for producing the electrode is described below in simplified manner.

First, a given length of rod material is cut from a raw rod material. Thus, cutting work for forming the main component 21 and the cover component 22 of the electrode body is carried out. A cavity is formed in the main component 21 in order to form a space inside the electrode body. Also, an opening is also formed in the cover component 22 for filling the electrode body with a heat conductor. When the two are being formed, the edge areas 24, 24' of the openings are welded to one another over the entire circumference of the openings. The electrode body is completed by hermetically sealing the connection of the two parts 21, 22. Then, the heat conductor is added to the interior through the fill opening 23. When the fill opening 23 is closed, as shown in the arrangement in FIG. 2, for example, the arrangement in which the heat conductor M is located in the hermetically sealed space S, is completed.

In machining of the cover component 22 by cutting, the insertion opening 22*o* for the coupling of the axial part (inner lead pin) of the electrode is formed at the back end 22*a*. A given axial part (inner lead pin) 5 is inserted into this insertion opening 22*o*. By welding the two to one another they can be securely joined to one another.

In the arrangement shown in FIG. 2, the electrode body 20 is made of tungsten, for example, and has the outside diameter D of 25 mm, the inside diameter d of 17 mm, the thickness $T_1$ of the side wall of 4 mm (average), and the thickness $T_2$ of the wall on the side of the opposite electrode of 4 mm.

It is advantageous for the thickness $T_1$ of the side wall of the electrode body (thickness of the body 20*b*) and the thickness $T_2$ of the wall on the side of the opposite electrode (thickness of the tip area 20*c*) to be at least 2 mm and at most 10 mm. This is because, at greater than 10 mm, the heat conduction effect by the heat conductor can no longer be obtained, and at less than 2 mm, there is the possibility of formation of a fracture by thermal shock as a result of an increased temperature gradient.

In the case where the electrode body is made of tungsten, with its tip area 20*c* being doped with potassium, the probability of a fracture occurring due to thermal shock as a result of the temperature gradient at a thickness of the tip area from 2 mm to 4 mm can be reduced.

It is advantageous to add the heat conductor M with a ratio of at least 30% by volume to the inside volume of the electrode body 20. It is especially advantageous to add it in the range from 50% by volume to 95% by volume because, when the amount of heat conductor M added is low, the action of dissipating the heat formed in the tip area 20*c* of the electrode body 20 to the back end 20*a* can no longer be easily obtained. Therefore, this causes a temperature increase of the tip area 20*c*.

Furthermore, it is more effective to add the heat conductor M moderately to the cavity than to completely fill the interior S of the electrode body 20 because, due to the presence of the cavity, the distribution of current, which flows in the molten heating conductor, changes in the vicinity of the cavity. The Lorentz force formed by the changing of the current distribution increases the convection flow velocity of the molten heating conductor, hence, the heat transport is increased.

There is also a cooling action for a small space not filled with the heat conductor M in the cavity of the electrode body. It is, however, desirable for the unfilled space in the cavity to be at least 5% by volume of the inside volume of the interior S.

An extremely high heat transport effect by the heat conductor can be developed by this formation of the electrode with a new arrangement of the present invention, in which there is an electrode body having a hermetically sealed space filled with a metal having a higher thermal conductivity than the metal comprising the electrode body as the heat conductor M. By this present invention, the disadvantages of melting, vaporization and the like due to the increase of the temperature of the electrode tip can be eliminated.

Specifically, the current to be supplied can be increased even more than in a conventional solid electrode of tungsten or the like. Thus, an arrangement of the discharge lamp with an increased output power is possible, while there is no need for a large cooling device outside the discharge lamp, as is the case in a conventional discharge lamp of the water cooling type. Thus, an effective cooling action of the electrode can be obtained by an extremely simple arrangement of the present invention.

The second aspect of the invention is described below.

FIGS. 1 to 3 used for the describing of the first aspect of the invention can likewise be used for the second aspect. The second aspect of the invention is, therefore, described using the same drawings and the same reference numbers.

This aspect of the invention is characterized in that the heat conductor M added to the electrode body 20 consists of a metal which has a lower melting point than the melting point of the metal comprising the electrode body 20. The melting of the heat conductor during operation of the discharge lamp causes a convection action in the hermetically sealed space of the electrode body, by which a heat transport effect is developed.

The electrode body 20 is made of a metal with a high melting point or of an alloy with the main component being a metal with a high melting point, as in the above-described aspect of the invention. It is preferably made of tungsten or an alloy with tungsten as the main component.

For the heat conductor M, a metal with a lower melting point than the melting point of the metal comprising the electrode body is used. In the case where tungsten is used for the electrode body 20, gold, silver, copper, indium, tin, zinc, lead or the like can be used for the heat conductor M. These metals should be monatomic metals or alloys. Also a single type of metal can be used or a combination of at least two types of metal can be used.

In the case of using a metal such as gold, silver and copper as the heat conductor M, during operation of the lamp, in addition to the heat transport action by heat conduction described in the first aspect of the invention, heat transport action by convection, which relates to the second aspect of the invention, can be used at the same time. Therefore, the synergistic action of the two can transport heat which forms in the tip area 20*c* of the electrode with a higher temperature to the back end 22*a* and to the axial part 5 with extremely high efficiency.

In the case of using one of the metals indium, tin, zinc, and lead as the heat conductor M, during lamp operation at a temperature of roughly 2000 K, for example, in the hermetically sealed space of the electrode body 20, a molten state is reached. The heat formed in the tip area of the electrode can be advantageously transported to the back end and to the axial part by the convection action.

However, since these metals have lower thermal conductivities than the tungsten comprising the electrode body 20, the heat conduction action of the first aspect of the invention cannot be expected. In the case of the current to be supplied to the discharge lamp is of a value of greater than or equal to 150 A, the convection action of the heat conductor alone is generally not enough. Hence, in this case, it is advantageous to use a heat conduction action at the same time.

Figure 4:
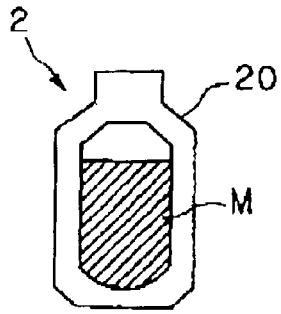
FIGS. 4(*a*) & 4(*b*) each shows a schematic of an electrode of the present invention.
Figure 4:
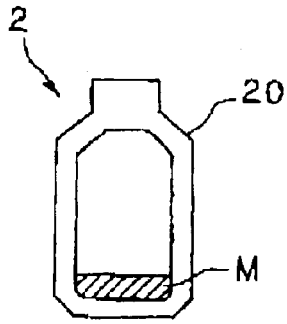

FIGS. 4(*a*) & 4(*b*) each shows, in a schematic cross section, the electrode body 20 and the heat conductor M. FIG. 4(*a*) shows a case in which a large amount of the heat conductor M is added with respect to the inside volume of the electrode body 20. In such a case of a large amount of heat conductor M being added, by convection of the liquid phase of the melted heat conductor M, the heat formed in the tip area can be transported with extremely high efficiency. As a result, the temperature of the tip area of the electrode can be very effectively reduced.

Specifically, it is desirable for at least 50% of the inside volume of the electrode body 20 be filled with the heat conductor M. As described above in the first aspect of the invention, it is more effective to add the heat conductor M in moderate quantity than to completely fill the interior of the electrode body 20. The upper boundary of the added amount is therefore less than 100%. However, it is desirable in practice for the amount of the heat conductor M to be at most 95% of the inside volume.

It is advantageous for the base area, on the side of the tip, of the interior to be made almost round in the electrode body 20. This is because convection of the heat conductor M proceeds smoothly without build-up due to the near roundness, and thus, the efficiency of heat transport can be increased.

In the electrode body 20, the space that is not filled with the heat conductor M can be filled with a high-pressure gas. In this case, formation of bubbles on the interface between the inside surface of the electrode body 20 and the heat conductor M can be suppressed. Thus, heat transport loss by bubble formation can be prevented. Specifically, added gas of at least 1 atm is sufficient.

FIG. 4(*b*) shows the case of a small amount of the heat conductor M being added with respect to the inside volume of the electrode body 20. In case of a small amount of the heat conductor M added, it is advantageous to fill the space that is not filled with the heat conductor with a gas, such as argon or the like. In this way, a state with a lower pressure than atmospheric pressure is formed, by which boiling of the heat conductor can be accelerated. Accordingly, heat transport action by boiling transfer can develop.

Specifically, the amount of the heat conductor M fills at most 20% of the inside volume of the electrode body 20. In the case of using indium, tin or zinc as the heat conductor, this arrangement is advantageous and effective, especially when using indium. Adding gas with a lower pressure than atmospheric pressure to the interior of the electrode body is not limited to the case of a small amount of heat conductor being added to the inside volume of the electrode body.

The arrangement described above using FIG. 4(*b*) is effective when the discharge lamp is arranged such that its tube axis is in the vertical direction and the electrode 2 are located at the top. This is because the electrode 2 can transport heat in the interior by boiling from the tip area of the electrode to the back end and to the axial part that are located at the top, as a convection action by the boiling of the heat conductor is present. The tube axis of the discharge lamp is defined as a virtual axis which is formed in the direction in which the two electrodes extend.

It is desirable for the inside surface of the electrode body 20 to be smooth. The reason is that the heat conductor in the liquid state can be prevented from coagulating locally. This local coagulation causes formation of stress and leads to fracture of the electrode body.

This treatment can be carried out over the entire inside surface of the electrode body. However, it is desirable for at least the vicinity of the area of the liquid level of the heat conductor to be treated, since this area of the liquid level is the location at which the heat conductor starts to easily coagulate. The numerical value of the amount by which the inside surface of the electrode body is smoothed is, for example, at least 25 $\mu$mRa. This value is determined by the JIS standard B0601.

Under certain circumstances, it is desirable for the inside surface of the electrode body 20 that corresponds to the tip area 20*c* to be formed relatively coarsely. This is because the contact surface of the metal comprising the electrode body 20 becomes greater with the heat conductor M, and, thus, heat is formed in the tip area 20*c* can be advantageously transferred to the heat conductor M.

The circumstances described in the first aspect of the invention, i.e., the advantage due to the hermetically sealed enclosure of the interior of the electrode body 20, the fixing of the shape and size of the crystal grains in the case where the metal comprising the electrode body is a multiple crystal such as tungsten, doping of the electrode body with potassium and the addition of an oxygen getter together with the heat conductor M to the electrode body 20, can likewise be used in the second aspect of the invention.

Figure 5:
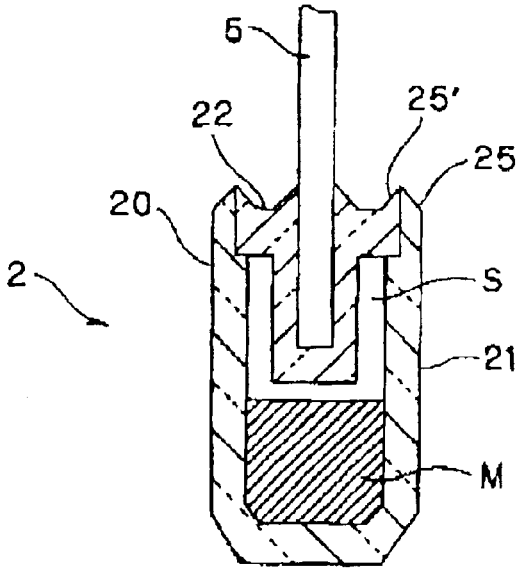
FIG. 5 shows a schematic of the specific arrangement of the electrode of the present invention.

FIG. 5 shows another embodiment of the electrode arrangement of the invention. This arrangement can be used both for the first and also the second aspect of the invention. Since the same reference numbers as those shown in FIGS. 1 to 4(*a*), 4(*b*) label the same parts, they are not repeatedly described here.

The electrode body 20 has a main component 21 and a cover component 22. By welding the opening edge areas 25, 25' of the main component 21 and the cover component 22 to one another, after introducing the heat conductor M into the main component 21, a hermetically sealed interior is formed. After welding, the difference between the main component 21 and the cover component 22 no longer exist, as in the arrangement shown in FIG. 2. In this embodiment, however, the two are feasibly distinguished from one another and are illustrated in this way for the sake of explaining the embodiment.

The cover component 22 extends into the interior S. The size of the interior S can be fixed at the desired value, and, moreover, the location at which the main component 21 and the cover component 22 are welded to one another can be moved away from the location at which the heat conductor M is located. The welding work is therefore simplified. Furthermore, the work of adding the heat conductor M is simplified. The advantage in the production process of the electrode is therefore very significant. The cover component 22 can also extend into the interior S until it comes into contact with the heat conductor M.

Figure 6:
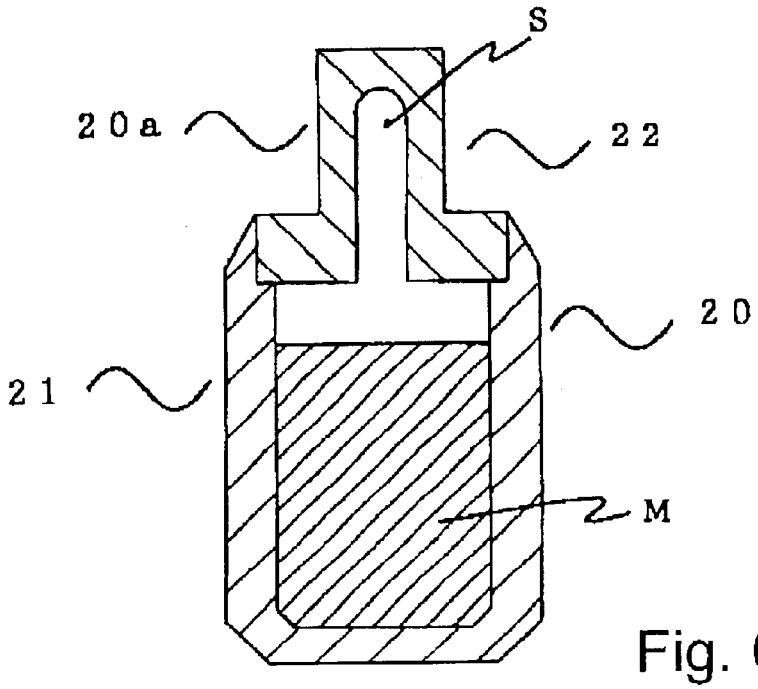
FIG. 6 shows a schematic of the specific arrangement of the electrode of the present invention.

FIG. 6 shows another embodiment of the electrode arrangement of the present invention. This arrangement can be used with the second aspect of the invention. Since the same reference numbers as those shown in FIG. 1 to FIG. 4(*a*), 4(*b*) label the same parts, they are not repeatedly described here. The electrode body 20 is formed of the main component 21 and the cover component 22. The interior S is filled with an amount of the heat conductor M. The cover component 22 has a back end 20*a* which extends as part of the axial part. Part of the interior is continuously connected to this back end 20*a*. The advantage due to this arrangement is that heat transfer is achieved by the boiling transfer action and the convection effect of heat conductor within the back end 20*a*. The back end 20*a* is coupled to the axial part, and the inner lead of the electrode and is supported within the emission part of the discharge lamp.

As described above, a new arrangement of the electrode is provided in the present invention. The electrode is comprised of an electrode body in which a hermetically sealed space is formed, and to which the heat conductor is added. The first aspect of the invention is characterized in that the metal comprising the heat conductor has a higher thermal conductivity than the metal comprising the electrode body. The second aspect of the invention is characterized in that the metal comprising the heat conductor has a lower melting point than the metal comprising the electrode body.

It is certainly advantageous for the electrode arrangement of the present invention to be used as an anode in a discharge lamp of the DC operating type. However, the use of the electrode arrangement for a cathode is not precluded. Furthermore, this arrangement can also be used for the two electrodes. It also goes without saying that the electrode arrangement of the present invention can also be used for the two electrodes in a discharge lamp of the AC operating type.

Furthermore, it is advantageous to use the electrode arrangement of the present invention in a so-called discharge lamp of the vertical operating type, which is operated in a manner such that the tube axis of the discharge lamp is in the vertical direction for an electrode located on the top side that easily reaches a high temperature. It is especially preferred that it be used in particular in the second aspect of the invention for the electrode located at the top, as heat is concentrated there causing melting of the electrode during lamp operation. However, the use for an electrode located at the bottom in a discharge lamp of the vertical operating type is not precluded. If the disadvantages which arise in other practical cases can be eliminated, it can also be used for an electrode which is located at the bottom.

Furthermore, the use of the discharge lamp in accordance with the invention for a so-called discharge lamp of the horizontal operating type is possible, in which the tube axis is located horizontally with respect to ground, or for a discharge lamp in which the tube axis is located obliquely with respect to ground.

The discharge lamp of the present invention is not limited solely to a high pressure mercury lamp of the short arc type, but can also be used for a xenon lamp with xenon as the emission substance, a metal halide lamp with rare earth metals besides mercury as the emission substance, or for a discharge lamp filled with halogen, without being limited to a certain emission substance. Furthermore, the discharge lamp as of the invention can be used without limitation to a discharge lamp of the short arc type also for a discharge lamp of the middle arc type and a discharge lamp of the long arc type and, moreover, for different discharge lamps, such as a low pressure discharge lamp, a high pressure discharge lamp, an ultrahigh pressure discharge lamp and the like.

The electrode arrangement of the invention is not limited to producing the respective part as a material component by machining of rod material, but the respective component can also be produced by another process such as a sintering process or the like.

In the electrode arrangement of the present invention, the electrode inherently has a high heat transport effect. Concomitant use of another forced cooling means is, however, not precluded. For example, a forced cooling means can also be used in which cooling air is allowed to flow outside the discharge lamp. The electrode of the present invention is not limited to the form shown in the embodiment but can also be subjected to a suitable change of shape, such as, for example, there can be a cooling rib or concave-convex on the side (in the body) of the electrode.

The invention is further described using a specific embodiment as follows:

An electrode with the same arrangement as the electrode arrangement shown in FIG. 5 was produced, and 20 mercury lamps were produced using this electrode as the anode of the discharge lamps of the present invention.

The arrangement of the respective part of the discharge lamp is described below.

(Discharge Lamp)

Nominal current: 280 A (in the test, however, operation was carried out at 200 A in order to be matched to a comparison lamp);

Inside volume of the arc tube: 1830 $cm^3$;

Emission length (distance between the electrodes; during lamp operation): 12 mm Xenon filling pressure: 100 kPa;

Amount of mercury: 28.2 $mg/cm^3$;

(Electrode on the Anode Side)

Material of the electrode body: tungsten; length in the axial direction: 55 mm; outside diameter of the body: 25 mm;

Inside volume: 9100 $mm^3$;

Material of the heat conductor: silver; amount added 6000 $mm^3$;

Material of the inside lead pin: tungsten; outside diameter: 6 mm;

(Electrode on the Cathode Side)

Material of the electrode body: thoriated tungsten (thorium oxide: 2% by weight);

Material of the inner lead pin: tungsten, outside diameter: 6 mm.

COMPARISON EXAMPLE

As comparison lamps, 20 conventional lamps were produced using an electrode composed entirely of tungsten. These comparison discharge lamps, except for the different anode arrangement, have the same arrangement as the above described discharge lamps as in accordance with the invention.

EXPERIMENTAL EXAMPLE

The discharge lamps of the present invention and the comparison discharge lamps were subjected to vertical operation at a current of 200 A such that the anode was .located at the top. After operation of 600 seconds of the respective discharge lamp, the surface temperature of the anode was measured by a "micropyrometer" at five points. Specifically, in the twenty discharge lamps of the present invention and the twenty comparison discharge lamps, a single measurement was taken for each lamp, and the average of these twenty lamps determined.

Figure 7:
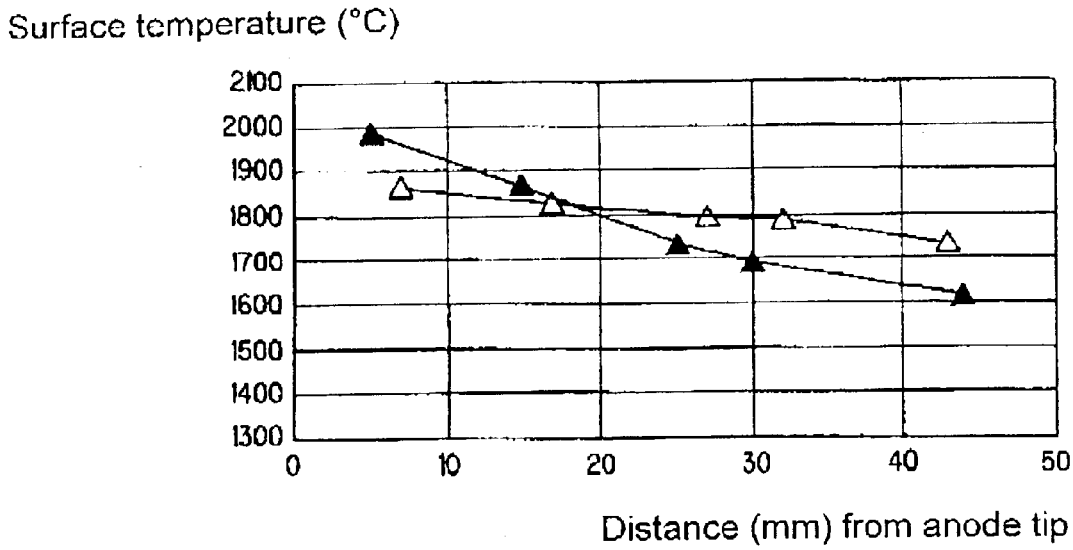
FIG. 7 is a graph depicting experimental results.

FIG. 7 shows the result of the above-described experiment. Here, the y-axis plots the surface temperature (degrees C.) of the anode, and the x-axis plots the distance (mm) from the tip area of the anode. The white triangles label the discharge lamps of the invention, and the black triangles label the comparison discharge lamps.

The measurement points of the discharge lamp are located at five locations which are essentially distributed uniformly from the tip area of the anode to the back end (at one point with roughly 5 mm, at one point with roughly 15 mm, at one point with roughly 25 mm, at one point with roughly 30 mm and at one point with roughly 45 mm). Since the measurement points deviate slightly depending on the lamps, the average of the twenty discharge lamps is shown in FIG. 7.

It is apparent from the experimental results that, in the tip area of the electrode (at the point roughly 5 mm from the tip), the comparison discharge lamps have a temperature of roughly 2000° C., while the discharge lamps of the present invention have a lower temperature of roughly 1850° C. On the other hand, it becomes apparent that, in the back end of the electrode (at the location roughly 45 mm from the tip), the comparison discharge lamps have a temperature of roughly 1600° C., while the discharge lamps of the present invention have a high temperature of roughly 1750° C.

It can be understood such that the heat which is formed in the tip area is effectively transported to the back end because the discharge lamps of the present invention have an outstanding heat transport characteristic of the electrode arrangement.

As described above, in the first aspect of the invention a new arrangement of the electrode is undertaken in which there is an electrode body having a hermetically sealed space filled with a metal heat conductor with a higher thermal conductivity than the metal comprising the electrode body. In this way, an extremely high heat transport effect can be developed by the conductive effect of the heat conductor, and the disadvantages of melting, vaporization and the like due to the temperature increase of the electrode tip can be eliminated.

In the second aspect of the invention, a new arrangement of the electrode is undertaken in which there is an electrode body having a hermetically sealed space filled with a metal heat conductor with a lower melting point than the melting point of the metal comprising the electrode body. In this way, an extremely high heat transport effect can be developed by the convection action by the heat conductor, and the disadvantages of melting, vaporization and the like due to the increasing temperature of the electrode tip can be eliminated.

What we claimed is:

1. Discharge lamp having an arc tube, comprising:

a pair of opposed electrodes, wherein at least one of the electrodes has a metallic electrode body having a hermetically sealed interior space; and a heat conductor disposed in the hermetically scaled interior space, wherein the heat conductor consists of metal that has a higher thermal conductivity than the metal comprising the electrode body.

2. The discharge lamp as claimed in claim 1, wherein the electrode body comprises a metal with tungsten as a main component.

3. The discharge lamp as claimed in claim 2, wherein the electrode body has a wall thickness at a tip end of the electrode of at least 2 mm and at most 10 mm.

4. The discharge lamp as claimed in claim 2, wherein in the electrode body comprises a wall doped with at least 1 wt. ppm and at most 50 wt. ppm of potassium.

5. The discharge lamp as claimed in claim 1, wherein the heat conductor comprises one of gold, silver, and copper.

6. The discharge lamp as claimed in claim 1, wherein the discharge lamp is operated a tube axis thereof oriented in the vertical direction with an anode electrode located at the top.

7. The discharge lamp as claimed in claim 1, wherein the hermetically sealed interior space is partially filled with the heat conductor.

8. The discharge lamp as claimed in claim 7, wherein a remaining part of the hermetically sealed interior space that is not filled with the heat conductor is filled with a gas.

9. The discharge lamp as claimed in claim 1, wherein an oxygen getter is also located in the hermetically sealed space.

10. The discharge lamp as claimed in claim 1, further comprising a holder upon an end of which the electrode body is mounted, an opposite end of the holder extending through hermetically sealed end parts of the arc tube.

11. A discharge lamp having an arc tube and a pair of opposed electrodes in the arc tube, wherein at least one of the electrodes has a metallic electrode body with a hermetically sealed interior space, wherein a heat conductor is located in the hermetically sealed interior space, and wherein the heat conductor consists of metal with a lower melting point than a melting point of the metallic electrode body.

12. The discharge lamp as claimed in claim 11, wherein the heat conductor contains one of the metals gold, silver, copper, indium, tin, zinc, and lead.

13. The discharge lamp as claimed in claim 11, wherein the discharge lamp is operated a tube axis thereof oriented in the vertical direction with an anode electrode located at the top.

14. The discharge lamp as claimed in claim 11, wherein the hermetically sealed interior space is partially filled with the heat conductor.

15. The discharge lamp as claimed in claim 14, wherein a remaining part of the hermetically sealed interior space that is not filled with the heat conductor is filled with a gas.

16. The discharge lamp as claimed in claim 11, wherein an oxygen getter is also located in the hermetically sealed space.

17. The discharge lamp as claimed in claim 11, further comprising a holder upon an end of which the electrode body is mounted, an opposite end of the holder extending through hermetically sealed end parts of the arc tube.

* * * * *